United States Patent [19]

Materna

[11] Patent Number: 4,960,058

[45] Date of Patent: Oct. 2, 1990

[54] SELF-POSITIONING REFRACTORY STRUCTURE

[75] Inventor: William R. Materna, Dubuque, Iowa

[73] Assignee: Merkle Engineers, Inc., Galena, Ill.

[21] Appl. No.: 427,044

[22] Filed: Oct. 26, 1989

[51] Int. Cl.[5] ..... F23M 5/00

[52] U.S. Cl. ..... 110/336; 110/338; 432/119

[58] Field of Search ..... 110/336, 337, 338, 335; 432/119

[56] References Cited

U.S. PATENT DOCUMENTS

| | | | |
|---|---|---|---|
| 1,582,275 | 4/1926 | Kellner . | |
| 1,636,603 | 7/1927 | Hamilton . | |
| 1,710,901 | 4/1929 | Schroeder . | |
| 1,764,707 | 6/1930 | Abbott . | |
| 1,789,074 | 1/1931 | Jacobus et al. . | |
| 2,132,517 | 10/1938 | Reintjes . | |
| 2,272,015 | 2/1942 | Lanyon . | |
| 2,446,766 | 8/1948 | Hosbein et al. . | |
| 2,457,965 | 1/1949 | Young . | |
| 2,524,722 | 10/1950 | Weber et al. . | |
| 2,634,694 | 4/1953 | Hazen . | |
| 2,657,651 | 11/1953 | Forsyth . | |
| 2,664,836 | 1/1954 | Rawlings . | |
| 2,685,264 | 8/1954 | Reintjes . | |
| 2,738,744 | 3/1956 | Longenecker . | |
| 2,870,624 | 1/1959 | Sampson . | |
| 3,132,447 | 5/1964 | Hosbein . | |
| 3,239,984 | 3/1966 | Hosbein . | |
| 3,362,698 | 1/1968 | Cerny et al. | 110/336 X |
| 3,958,519 | 5/1976 | Merkle, Jr. . | |
| 4,463,689 | 8/1984 | James . | |
| 4,569,659 | 2/1986 | Olsen et al. | 110/336 X |
| 4,864,945 | 9/1989 | Merkle . | |

*Primary Examiner*—Edward G. Favors

*Attorney, Agent, or Firm*—Thomas W. Speckman; Douglas H. Pauley

[57] ABSTRACT

A self-positioning refractory structure having a generally cylindrical casing. A plurality of positioning refractories, a plurality of filler refractories and a plurality of wedge refractories are interlocked with respect to each other and positioned to form a structure having a curved cross section within the cylindrical casing. The positioning, filler and wedge refractories are interlocked with respect to each other. The length of each positioning refractory is greater than the length of each filler and wedge refractories thus defining an annular space between the casing wall and the refractories. Each positioning refractory has a cold end in positioning and supporting contact with an inside wall of the casing and a hot end directed toward a center of the self-positioning refractory structure.

33 Claims, 4 Drawing Sheets

SELF-POSITIONING REFRACTORY STRUCTURE

BACKGROUND OF THE INVENTION

1. Field of the Invention

This invention relates to a self-positioning refractory structure, preferably having a circular cross-section and particularly for a generally circular air-cooled incinerator afterburner.

2. Description of the Prior Art

Existing furnace wall constructions that have a space between the cold side of the refractories and a casing wall or other structural support use complex arrangements of structural steel to support the refractories. Most often, castings, I-beams, clamps, and other specially fabricated structural components are used to suspend the refractories from a furnace roof or furnace wall.

A common method of incinerating hazardous waste is to use a rotary kiln with an afterburner. Hazardous waste is charged into the rotary kiln and tumbles causing the waste to release most of its heat content. Product gases enter an afterburner and must be burned at up to 2200° F., according to environmental regulations, with a one or two second retention, depending upon the type of hazardous waste or other waste. Such afterburners have either a rectangular or generally circular cross section. Round afterburners are constructed with either monolithic materials or brick. Most brick constructions use straight-sided wedge shaped bricks which are installed in rings and suspended from structural shelves. Insulation is also normally installed in the afterburner. According to the prior art, cooling the wall behind such types of refractory with air flow is virtually impossible since the brick tends to move toward the casing thus eliminating any available space for air flow between the refractories and the casing wall.

High temperature furnaces may include a curved wall portion known as a fantail turn or nose construction which makes the transition between a vertical or angled wall and a suspended horizontal roof, or between two walls having some other angular relationship to each other. Existing fantial turn or nose construction designs use refractories suspended from the cold side of a furnace with at least each pair of refractories requiring a suspension hanger. Such construction designs create a maze of suspension hangers. Existing nose constructions generally comprise a plurality of wedge-shaped refractories having a generally planar front, back and opposing sides which converge toward the cold side of the nose construction, as taught by U.S. Pat. Nos. 1,636,603, 1,764,707, 2,132,517, 2,272,015 and 2,685,264. U.S. Pat. No. 1,582,275 teaches a curved construction having hanger refractories with planar surfaces which converge toward the cold side and filler refractories with planar surface which converge toward the hot side.

U.S. Pat. No. 4,463,689 teaches a high temperature furnace nose construction providing refractory replacement from the cold side of a furnace. A plurality of wedge-shaped refractories and a plurality of rectangular-shaped refractories are arranged to form straight rows along the length of the nose construction. Both the rectangular-shaped and wedge-shaped refractories have planar sides and require a hanger to suspend two adjacent refractories.

U.S. Pat. No. 3,958,519 teaches high temperature furnace construction for flat roofs and walls using refractories having interlocking corrugations. Merkle Engineers, Inc. has used and sold for several years the rectangular filler and hanger refractories as described in the '519 patent. Merkle Engineers, Inc., P.O. Box 312, Galena, Ill. 61036, has published catalog brochures entitled "MODU-LOK" and "Suspended and Tied Back Refractory Systems for Incineration and Resource Recovery Projects" describing these rectangular filler and hanger refractories.

U.S. Pat. No. 1,710,901 discloses a furnace wall construction suspended from structural support members within a refractory wall. Rectangular refractories have T-slots for engagement with retaining flanges of hangers secured from the structural members. Reduced portions of the refractories leave vertical channels which extend through the wall and open into an air chamber. Each refractory of the furnace wall construction is suspended by a hanger.

U.S. Pat. No. 1,789,074 teaches a furnace wall construction having upright supporting members which structurally support holding plates and lining of the furnace wall. Angle braces provide further support between the upright supporting members and supporting plates adjacent to the lining.

U.S. Pat. No. 2,446,766 discloses a supported furnace arch or roof construction. The refractory members are suspended from crossbeams with metal hanger members and refractory hanger members. The crossbeam members are supported from main I-beams with clips.

U.S. Pat. No. 2,524,722 discloses a roof or arch construction for a furnace. A plurality of suspension tiles and roof tiles are suspended from brackets secured to I-beams which are disposed at right angles to another structural I-beam which is secured to a vertical I-beam post. Insulation may be disposed on the roof tiles and filler tiles. The filler tiles are supported by the roof tiles.

U.S. Pat. No. 2,634,694 discloses a suspended arch tile structure having face tiles suspended from hanger bricks which are suspended from channels or arches. The channels or arches are clamped to a structural beam by suitable clamping brackets. Intermediate tiles are supported by the face tiles.

U.S. Pat. No. 2,664,836 discloses a suspended roof structure having intermediate blocks supported by suspended blocks. The suspended blocks are supported by stringers which comprise channel beams. The stringers are suspended from a steel beam by fastening plates.

U.S. Pat. No. 2,870,624 discloses a furnace wall having a series of horizontal support bars bolted to inner faces of columns. Tile blocks are suspended from the support bars with high temperature alloy tile supporting hangers.

SUMMARY OF THE INVENTION

It is one object of this invention to provide a self-positioning refractory structure suitable for installation in a curved or generally circular casing, such as an air-cooled afterburner.

It is another object of this invention to provide a self-positioning refractory structure having a combination of straight or rectangular refractories and wedge-shaped refractories which are each interlocked with respect to adjacent refractories.

It is another object of this invention to provide a self-positioning refractory structure wherein the interlocked refractories form a positioning refractory ring and each positioning refractory ring is stacked and interlocked with respect to another positioning refractory ring and/or a non-positioning refractory ring to form a self-positioning refractory ring wall within a generally cylindrical casing.

It is yet another object of this invention to provide a self-positioning refractory structure having a space between the cold end of the refractories and the casing wall thereby forming a channel or annular space for air flow.

In one preferred embodiment of this invention, a self-positioning refractory structure requiring no structural tie-backs or positioners is housed within a generally cylindrical casing. Within the casing, a plurality of positioning refractories, filler refractories, and wedge refractories are all adjacently arranged to form a self-positioning refractory structure having a curved cross section within the casing. Such self-positioning refractory structure requires no hangers, tie-backs, positioners or other additional structural supports. The positioning, filler and wedge refractories are interlocked with respect to each other and thus form the self-positioning refractory structure. In a preferred embodiment, the length of each positioning refractory is greater than the length of either the filler or wedge refractory. Each positioning refractory has a cold end in supporting contact with an inside wall of the casing and a hot end directed toward a center of the structure.

The positioning and filler refractories each have a generally planar top and bottom. The front and back of the positioning and filler refractories are asymmetric about one plane parallel to and equidistant from outermost faces of the front and back. Both sides of the positioning and filler refractories are symmetric about another plane parallel to and equidistant from innermost faces of the sides.

Each wedge refractory has a generally planar top and bottom. In one preferred embodiment of this invention, each wedge refractory has a generally planar front and back. In another preferred embodiment of this invention, each wedge refractory has a front and back asymmetric about one plane parallel to and equidistant from outermost faces of the front and back. In both preferred embodiments described above, the wedge refractory has sides symmetric about another plane passing through midpoints of the top and bottom and perpendicular to the front and back of the wedge refractory. Each wedge refractory diverges along the sides from top to bottom thereby forming an overall wedge shape.

In one preferred embodiment of this invention, each wedge refractory has a thickness, between the front and back, approximately equal to an overall thickness of each positioning refractory and each filler refractory. Such thickness of the positioning and filler refractories is defined as the distance between outermost faces of the front and back of each positioning and filler refractory.

In one embodiment according to this invention, the bottoms of the positioning and filler refractories are directed toward the center of the self-positioning refractory structure. The bottoms of the wedge refractories are also directed toward the center of the self-positioning refractory structure.

In a preferred embodiment according to this invention, each filler refractory is interlocked between two wedge refractories which are interlocked between two positioning refractories. Such interlocking sequence forms a positioning refractory ring. A plurality of positioning refractory rings are stacked and interlocked with respect to another positioning refractory ring and/or a non-positioning refractory ring to form a self-positioning refractory ring wall within the cylindrical casing. Each positioning refractory ring includes a repeating sequence of a group of at least one positioning refractory, at least one filler refractory and at least one wedge refractory. In another preferred embodiment, each repeating sequence includes one positioning refractory interlocked with a first wedge refractory. The first wedge refractory is interlocked with one filler refractory which is interlocked with a second wedge refractory. The second wedge refractory is interlocked with another positioning refractory and the sequence then repeats.

It is apparent that other suitable sequences of positioning, filler and/or wedge refractories can be used to form a positioning refractory ring. For example, a positioning refractory ring may include all wedge refractories. In such embodiment, the lengths of certain wedge refractories are extended to convert them into positioning refractories, each having an overall wedge shape.

In another preferred embodiment according to this invention, the self-positioning refractory structure has at least one positioning refractory ring and at least one non-positioning refractory ring. The non-positioning refractory ring includes alternating filler and wedge refractories which are interlocked with respect to each other. Each positioning refractory ring is interlocked with respect to each adjacent non-positioning refractory ring. In one embodiment, a plurality, preferably four, of non-positioning refractory rings are interlocked between two of the positioning refractory rings and each non-positioning refractory ring is interlocked with respect to each other.

In another preferred embodiment according to this invention, the self-positioning refractory structure has insulation between the inside wall of the casing and the cold ends of the filler and wedge refractories. The insulation is preferably in a layer form. The insulation may be positioned adjacent the cold ends of the filler and wedge refractories and/or may be positioned adjacent the inside wall of the casing. A generally annular space preferably exists between the insulation and either the inside wall of the casing or the cold ends of the filler and wedge refractories, depending upon the positioning of the insulation. If the insulation is positioned adjacent the cold ends of the refractories and adjacent the inside wall of the casing, then it is preferred to have a generally annular space between each layer of insulation. In a preferred embodiment of this invention, the insulation has a thickness of about two inches. It is apparent that the thickness of insulation can vary considerably, depending upon the design parameters of the afterburner or other equipment being used with the self-positioning refractory structure.

In one embodiment of this invention, the self-positioning refractory structure has at least one shelf support secured to the inside wall of the casing. Each shelf support is used to provide additional axial support to the self-positioning refractory structure. Such shelf support is optional and not a necessary element of this invention.

BRIEF DESCRIPTION OF THE DRAWINGS

The above mentioned and other features of this invention and the manner of obtaining them will become more apparent, and the invention itself will be best understood by reference to the following description of specific embodiments taken in conjunction with the drawings, wherein.

DESCRIPTION OF THE PREFERRED EMBODIMENTS

Figure 1:
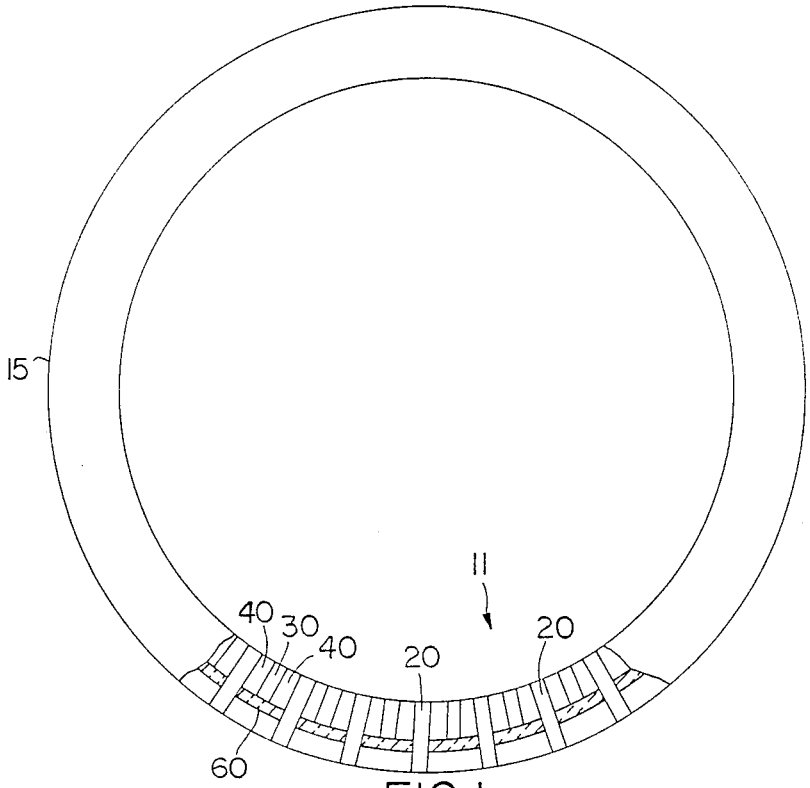
FIG. 1 shows a top view of a section of a positioning refractory ring of a self-positioning refractory structure according to one embodiment of this invention.

This invention relates to a self-positioning refractory structure which requires no structural hangers, tie-backs, positioners or other additional structural members to support the refractories. Such self-positioning refractory structure, as shown in FIGS. 1–4, is suitable for many uses, particularly afterburners of chemical waste incinerators.

This invention is particularly advantageous to construction of furnace walls having a generally circular cross section since combinations of interlocking positioning, filler and wedge refractories can be used to build a furnace having virtually any curvature or diameter. It is particularly important to construct the furnace wall to have a space between the cold end of the refractories and the casing wall of the furnace. Passing cooling air through such space removes gases which leak through the refractories and corrode the steel casing or other structural steel. Chemical waste incinerators commonly burn highly corrosive waste materials which create highly corrosive product gases. Such corrosive gases seep through the refractory during operation of theincinerator and condense on the shell, which is often steel, and thus cause corrosion. Air-cooled systems with a space between the shell and the refractories significantly reduce, if not eliminate, corrosion since the airflow through the space carries the highly corrosive gases away at a relatively high velocity. Furthermore, the warm air flowing through the space reduces the dew point and tends to keep the area dry.

Existing circular afterburners include extensive structural steel and the afterburners have not been designed to prevent corrosion to such structural steel. One method of reducing corrosion is to keep the casing wall or shell above the dew point, approximately 350°–375° F., so that corrosive gases do not condense and cause corrosion. Another disadvantage with existing afterburners is that the overall energy efficiency is poor since there is much heat loss. Another existing method used to reduce corrosion is to use enough insulation to bring the shell or casing wall temperature below 200° F. so that an acid resistant material can be applied to the casing or shell wall. Practically, this method presents problems with existing afterburners since it is difficult to keep the shell or casing wall temperature below 200° F. Structural steel or other metal anchors tend to conduct heat toward the casing or shell wall which causes hot spots. In one aspect, this invention overcomes such problems since the self-positioning refractory structure requires no structural steel or hangers and thus no hot spots are created at the casing or shell. The space between the refractories and the casing and the refractories are designed to accommodate sufficient airflow and insulation to maintain the shell or casing temperature below 200° F. In another aspect, this inventin overcomes such high temperature problems since the refractories are designed to create a space between the refractories and the casing. Airflow through such space reduces the casing temperature by convectional heat transfer from the refractories to the air flowing through the space. Through existing technology, casing or shell temperatures are reduced by increasing the refractory wall thickness, typically by two feet or more.

U.S. Pat. No. 4,864,945, owned by Merkle Engineers, Inc., discloses a curved nose construction for a high temperature furnace. The curved nose construction includes a combination of radial and rectangular filler refractories supported by rectangular hanger refractories. The radial and rectangular filler refractories have tread sides that interlock with tread sides of adjacent refractories. Each rectangular hanger refractory is suspended from a support structure with a structural hanger. The disclosure of the '945 patent is incorporated into this patent application by reference.

Figure 2:
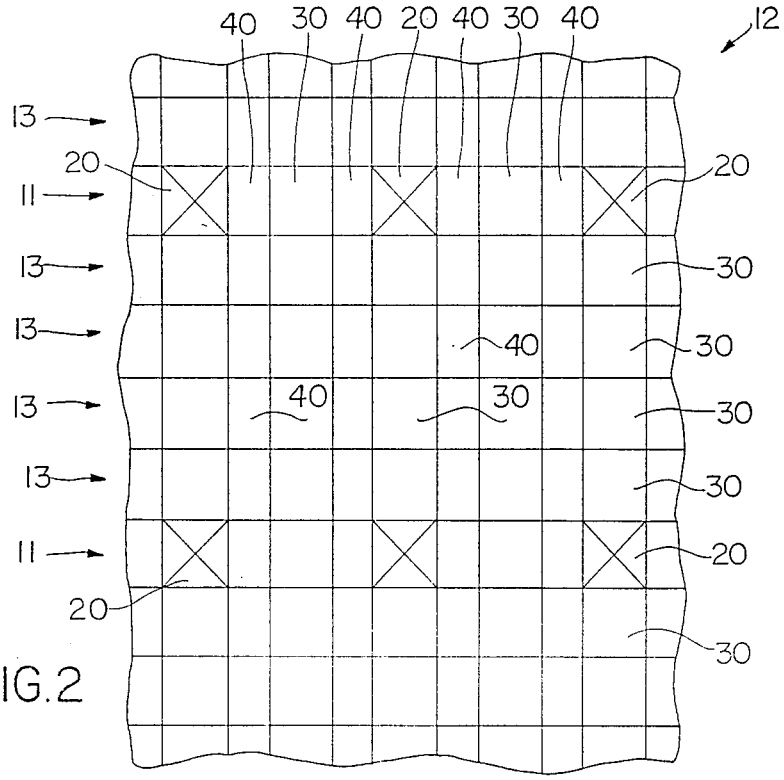
FIG. 2 shows a diagrammatic view of hot ends of stacked and interlocked positioning and non-positioning refractory rings according to one embodiment of this invention.

Referring to FIGS. 1–4 of this application, self-positioning refractory structure 10 comprises casing 15 which is used to provide base support to positioning refractories 20. A plurality of filler refractories 30 and wedge refractories 40 are interlocked between positioning refractories 20. The term "positioning", as used throughout this application, refers to refractories or other structural members that both position and provide support to other refractories or other structural elements. FIG. 1 shows a top view of positioning refractory ring 11. FIG. 1 does not show the details of each refractory. FIG. 2 shows a front view of the hot side of self-positioning refractory ring wall 12 having a plurality of positioning refractory rings 11 each interlocked between two adjacent non-positioning refractory rings 13.

It is apparent that any number of non-positioning refractory rings 13 that provide suitable structural support can be interlocked between two positioning refractory rings 11. FIG. 2 is a diagrammatic view in which the crossed-out rectangles represent hot ends 55 of positioning refractories 20. In a preferred embodiment of this invention, four non-positioning refractory rings 13 are interlocked between two positioning refractory rings 11, as shown in FIG. 2.

In a preferred embodiment according to this invention, a plurality of positioning refractories 20, a plurality of filler refractories 30 and a plurality of wedge refractories 40 are arranged to form a structure having a curved cross section within casing 15. The terms "generally cylindrical" and "generally circular" as used throughout the specification and claims is intended to relate to any suitable curved or curved and straight refractory structure and/or casing 15. Casing 15 preferably has a circular cross section; however, it is apparent that generally cylindrical casing 15 can also have a non-circular cross section, such as an oval, ellipse, two straight sections having semi-circular ends, or the like.

In one embodiment of this invention, the length of each positioning refractory 20 is greater than the length of each filler refractory 30 and is also greater than the length of each wedge refractory 40. Such dimensional arrangement provides for a space between the refractories and the casing wall through which cooling air can flow. Each positioning refractory 20 has cold end 54 in positioning and supporting contact with inside wall 16 of casing 15 and hot end 55 directed toward the center of self-positioning refractory structure 10.

Figure 5:
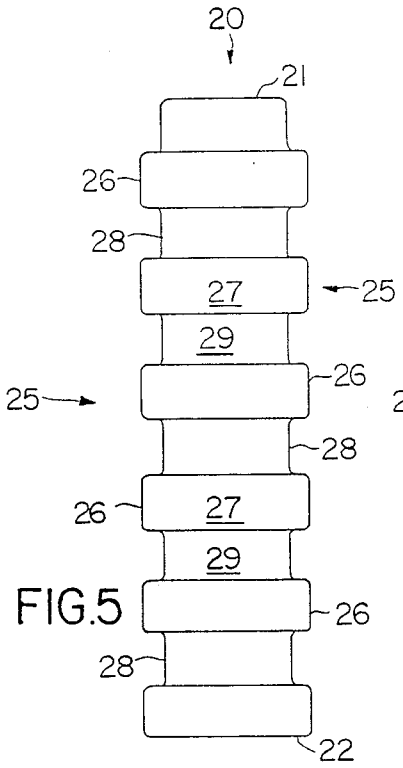
FIG. 5 shows a front view of a positioning refractory according to one embodiment of this invention.
Figure 6:
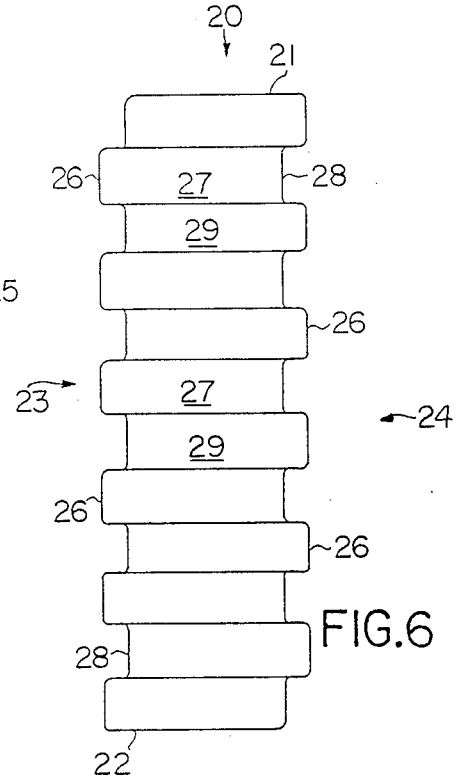
FIG. 6 shows a side view of the positioning refractory as shown in FIG. 5.

In a preferred embodiment according to this invention, positioning refractories 20 each have a generally planar top 21 and a generally planar bottom 22, as shown in FIGS. 5 and 6. Top 21 and bottom 22 can also have a curved surface or any other suitably shaped surface. The straight interlocking means comprise tread front 23 and tread back 24 asymmetric about a plane parallel to and equidistant from ridge faces 27, the outermost faces, of tread ridges 26 of tread front 23 and tread back 24. Each positioning refractory 20 further has tread sides 25 which are symmetric about another plane parallel to and equidistant from groove faces 29, the innermost faces, of tread grooves 28 of tread sides 25. FIGS. 5 and 6 show a preferred embodiment of this invention wherein the edges of tread ridges 26 and tread grooves 28 are rounded. It is apparent that tread ridges 26 and tread grooves 28 may also have squared edges or any other suitably shaped edges which accommodate the interlocking function of the refractories. FIGS. 5 and 6 also show a preferred embodiment of this invention wherein ridge faces 27 and groove faces 29 are generally planar; however, it is apparent that such surfaces may have any other suitable shape which accommodates the interlocking function of the refractories.

Filler refractories 30 each have a similar shape and arrangement to positioning refractories 20 as described above. In a preferred embodiment of this invention, the difference between filler refractory 30 and positioning refractory 20 is that filler refractory 30 is shorter than positioning refractory 20. Filler refractory 30 preferably has an overall length approximately equal to the overall length of wedge refractory 40, as described below. The refractories used in this invention may have different numbers of tread ridges and tread grooves than shown in the illustrated embodiments as long as their described relationships are maintained.

Figure 7:
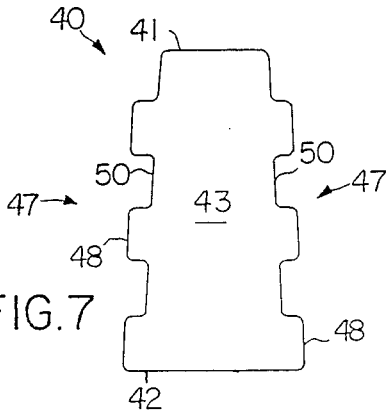
FIG. 7 shows a front view of a wedge refractory having a generally planar front and back according to one embodiment of this invention.
Figure 8:
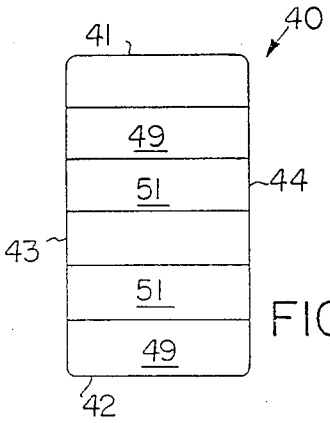
FIG. 8 shows a side view of the wedge refractory as shown in FIG. 7.

FIGS. 7 and 8 show one embodiment of wedge refractory 40 according to this invention. The wedge interlocking means of each wedge refractory 40 comprise wedge refractory 40 having generally planar top 41 and generally planar bottom 42. Top 41 and bottom 42 can also have a curved surface or any other suitably shaped surface. FIG. 7 shows wedge refractory 40 having generally planar front 43 and generally planar back 44. The wedge interlocking means further comprise tread sides 47 symmetric about a plane passing through midpoints of top 41 and bottom 42 and perpendicular to front 43 and back 44. The overall shape along tread sides 47 of each wedge refractory 40 diverges from top 41 to bottom 42.

Figure 9:
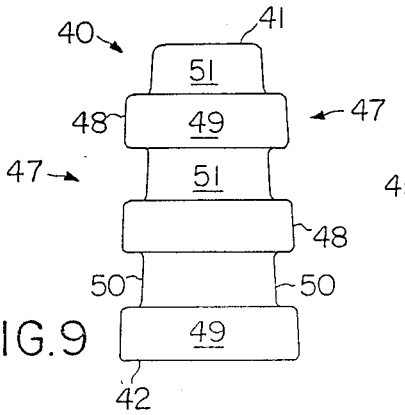
FIG. 9 shows a front view of a wedge refractory having a treaded front and back, according to another preferred embodiment of this invention.
Figure 10:
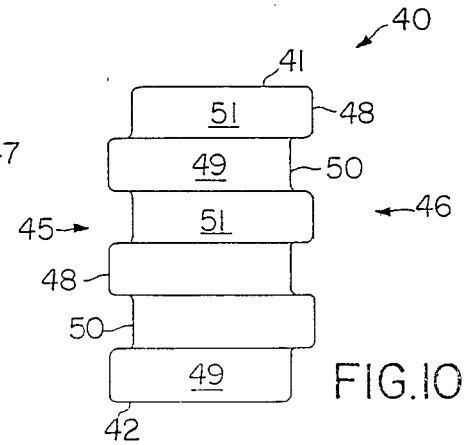
FIG. 10 shows a side view of wedge refractory as shown in FIG. 9.

In another preferred embodiment according to this invention as shown in FIGS. 9 and 10, the wedge interlocking means further comprise each wedge refractory 40 having tread front 45 and tread back 46 which are asymmetric about a plane parallel to and equidistant from ridge faces 49 of tread ridges 48. As shown in FIGS. 7–10 each ridge face 49 and groove face 51 has a generally planar surface; however, it is apparent that such faces can have other suitable shapes which accommodate the interlocking function of wedge refractory 40.

In one embodiment according to this invention, each wedge refractory 40 has tread groove 50 of tread side 47, as shown in FIGS. 9 and 10, adjacent bottom 42 which is directed toward the center of self-positioning refractory structure 10. Similarly, each positioning refractory 20 and each filler refractory 30 have tread ridge 26 of tread side 25 adjacent bottom 22 which is directed toward the center of self-positioning refractory structure 10. In another embodiment according to this invention, a wedge thickness between the front and back of each wedge refractory 40 is approximately equal to an overall thickness of each positioning refractory 20 and each filler refractory 30. Such overall thickness is defined as the distance between the outermost faces, ridge faces 27, of tread front 23 and tread back 24. In the embodiment of wedge refractory 40 as shown in FIGS. 9 and 10, such wedge thickness is defined as the distance between the outermost faces, ridge faces 49, of tread front 45 and tread back 46.

Figure 3:
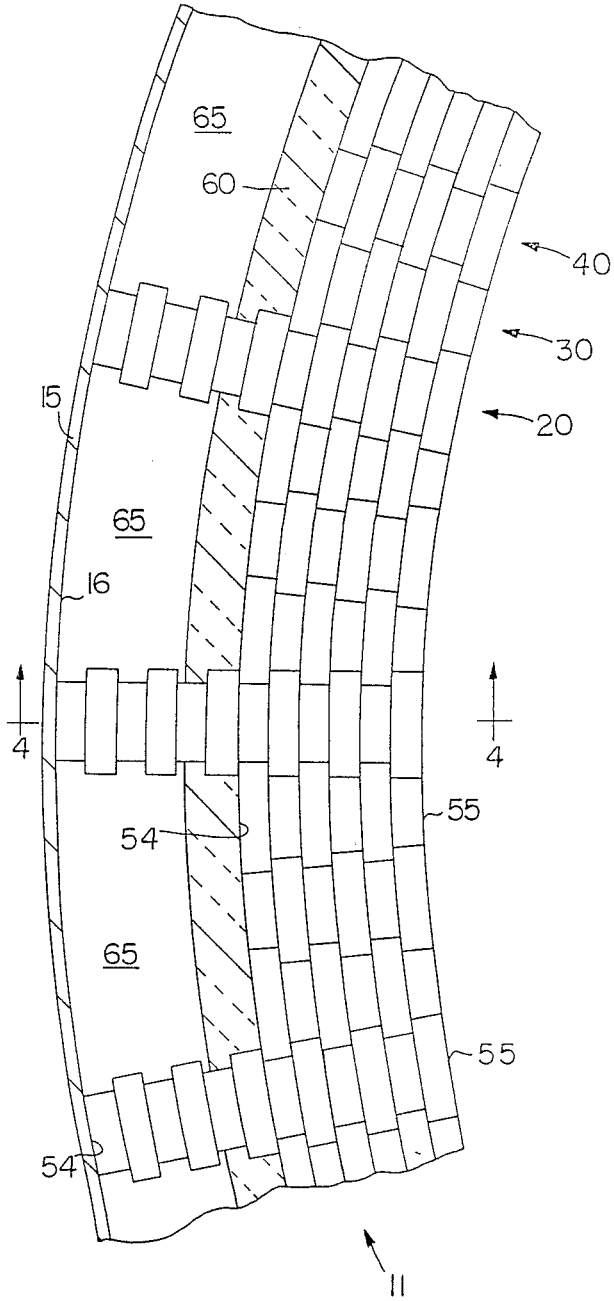
FIG. 3 shows an enlarged and detailed top view of a section of a positioning refractory ring according to the embodiment as shown in FIG. 1.
Figure 4:
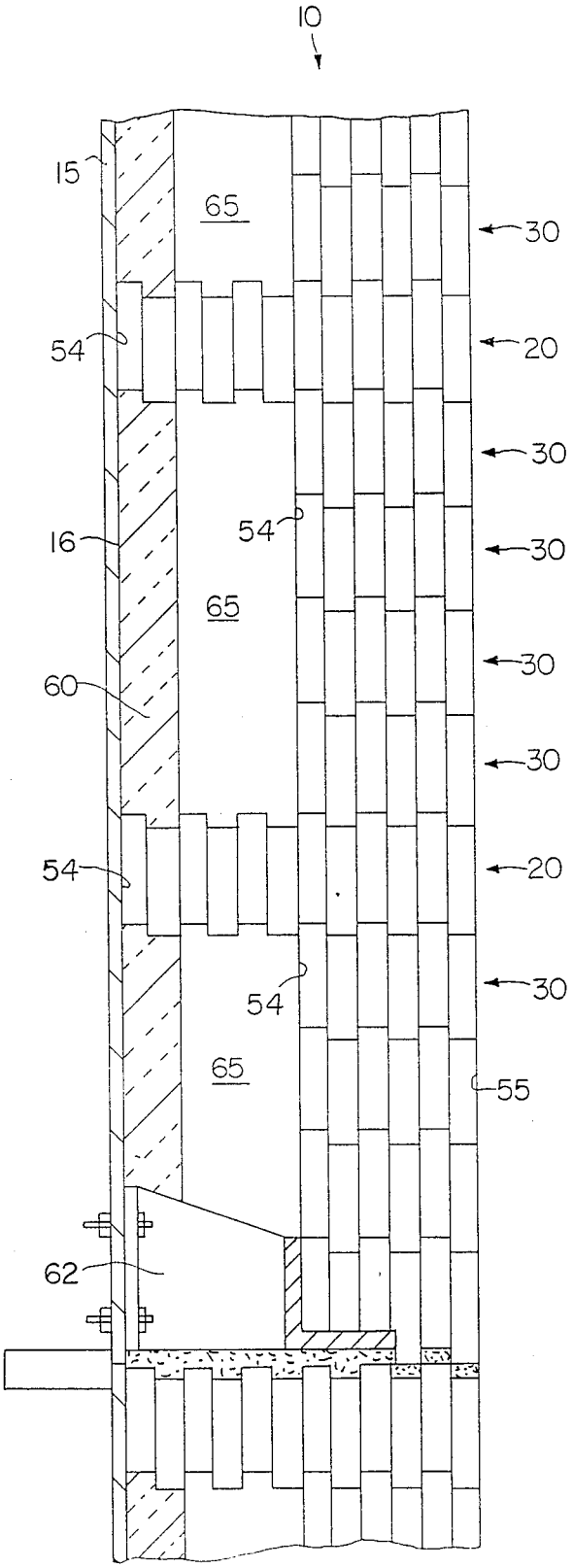
FIG. 4 shows a sectional view along line 4—4, as shown in FIG. 3, except with the insulation against the inside wall of the casing rather than the cold ends of the filler and wedge refractories, according to a preferred embodiment of this invention.

Positioning refractories 20 are longer than each filler refractory and each wedge refractory 40 in order to create space 65 as shown in FIGS. 3 and 4. In a preferred embodiment according to this invention, space 65 has an annular shape and allows air flow between cold ends 54, of filler refractories 30 and wedge refractories 40, and inside wall 16 of casing 15.

Figure 3A:
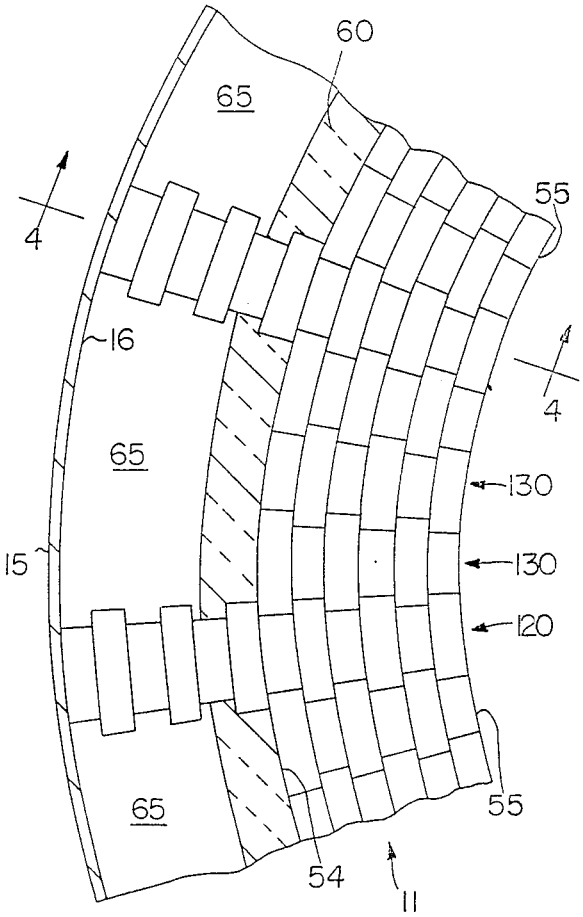
FIG. 3*a* shows an enlarged and detailed top view of a section of a positioning refractory ring according to another embodiment of this invention wherein the positioning refractory ring has all wedge-shaped refractories.

FIGS. 3, **3*a* and 4 show insulation 60 located between inside wall 16 of casing 15 and cold ends 54 of filler refractories 30 and wedge refractories 40. FIGS. 3 and 3*a* show insulation 60 positioned adjacent cold ends 54. FIG. 4 shows insulation 60 positioned adjacent inside wall 16 of casing 15. It is apparent that insulation 60 can be positioned adjacent cold ends 54 as well as adjacent inside wall 16 of casing 15. Insulation 60 preferably has a layer or blanket form. It is apparent that insulation 60 can also comprise other suitable type of insulation known to the art. In a preferred embodiment of this invention, insulation 60 has a thickness between approximately 1 inch and 4 inches, preferably 2 inches. It is also apparent that the thickness of insulation can vary considerably, depending upon the design parameters of the afterburner or other equipment being used with self-positioning refractory structure 10**.

As shown in FIG. 3, one preferred embodiment of positioning refractory ring 11 has filler refractory 30 interlocked between two wedge refractories 40 which are interlocked between two positioning refractories 20. FIG. **3*a* shows another preferred embodiment of positioning refractory ring 11 having all wedge-shaped refractories. Such embodiment with all wedge-shaped refractories allows self-positioning refractory structure 10 to have a smaller radius of curvature as opposed to self-positioning refractory structure 10 having wedge-shaped and rectangular-shaped refractories. FIG. 3***a* shows three filler wedge refractories 130 interlocked between two positioning wedge refractories 120. In the cross section shown in FIG. 3*a*, each filler wedge refractory 130 diverges in a direction from hot end 55 to cold end 54. Although not essential, it is preferred to have an odd number of filler wedge refractories 130 positioned between two positioning wedge refractories 120 so that only one particular shape of positioning wedge refractory 120 is necessary to interlock with adjacent filler wedge refractories 130. As shown in FIG. 3*a*, positioning wedge refractory 120 diverges from hot end 55 to cold end 54. It is apparent that for interlocking purposes, such diverging characteristic of positioning wedge refractory 120 is only required as far as the cold end 54 of filler wedge refractory 130; beyond such point, positioning wedge refractory 120 can have any cross-sectional configuration suitable for the desired support.

Although FIG. 3*a* shows a preferred embodiment of this invention having all wedge-shaped refractories, it is apparent that filler wedge refractory 130 and positioning wedge refractory 120 have characteristics similar to those of positioning refractory 20, filler refractory 30 and wedge refractory 40, as described throughout this specification.

In another preferred embodiment of this invention, self-positioning refractory structure 10, as shown in FIG. 2, has a plurality of positioning refractory rings 11 and non-positioning refractory rings 13 stacked and interlocked with respect to each other forming self-positioning refractory ring wall 12 within casing 15. In a preferred embodiment, each positioning refractory ring 11 comprises a repeating sequence of a group of at least one positioning refractory 20, at least one filler refractory 30 and at least one wedge refractory 40. Each repeating sequence may further comprise one positioning refractory 20 interlocked with one wedge refractory 40 which is interlocked with one filler refractory 30 which is interlocked with another wedge refractory 40. It is apparent that any combination of refractories can be interlocked to obtain various curvatures or diameters of self-positioning refractory structure 10. As shown in FIG. 2, at least one positioning refractory ring 11 comprises each filler refractory 30 interlocked between two wedge refractories 40 which are interlocked between two positioning refractories 20. Each non-positioning refractory ring 13 comprises alternating filler refractories 30 and wedge refractories 40 interlocked with respect to each other. It is apparent that other suitable sequences of positioning refractories 20, filler refractories 30 and/or wedge refractories 40 can be used to form each positioning refractory ring 11 or each non-positioning refractory ring 13.

In another preferred embodiment, self-positioning refractory structure 10 comprises at least one group of a plurality of non-positioning refractory rings, preferably four, interlocked between two positioning refractory rings 11. Each non-positioning refractory ring 13 is interlocked with respect to each other.

As shown in FIG. 4, at least one shelf support 62 can be secured to inside wall 16 of casing 15. Shelf support 62 can be welded, bolted or secured in any other suitable manner to inside wall 16 of casing 15. Each shelf support 62 provides additional axial support to self-positioning refractory structure 10. In such embodiment, shelf support 62 is preferably made of a structural steel or another suitable metal. Shelf support 62 provides additional support for furnaces that are disassembled and transported in sections. Shelf support 62 also allows for easy removal of the refractories by releasing shelf support 62 and allowing the refractories to fall thereby creating instant tearout of the refractory structure. Instant tearout of the refractory structure is particularly suitable for transportable type afterburners in which sections are removed. Tearout of an afterburner according to this invention would be relatively easy since two anchors hold the structure in place, as opposed to a monolithic structure which has anchors and requires extensive labor for tearout.

Self-positioning refractory structure 10 according to this invention provides an energy efficient furnace or afterburner system in which air flows through space 65 for preheating the air to temperatures over 500° F., depending upon the volume of air, and dimensions of the afterburner. Using preheated air for combustion allows for nearly complete heat recovery of the heat transferred through positioning refractory ring wall 12. Insulation 60 against casing 15 reduces the average shell temperature of casing 15 to a temperature slightly over the ambient outside temperature. This is particularly advantageous for indoor furnace constructions.

It is apparent that the refractories described above can be of any suitable material known in the art. While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. In a furnace having a generally circular cross section, a self-positioning refractory structure comprising:

a generally cylindrical casing;

a plurality of positioning refractories each having straight interlocking means, a plurality of filler refractories each having said straight interlocking means, and a plurality of wedge refractories each having wedge interlocking means, arranged to form a cross-sectionally curved structure within said cylindrical casing;

said positioning refractories, said filler refractories and said wedge refractories interlocked by said straight interlocking means and said wedge interlocking means forming the self-positioning refractory structure; and a positioning length of each said positioning refractory being greater than a filler length of each said filler refractory and being greater than a wedge length of each said wedge refractory, each said positioning refractory having a cold end in positioning contact with an inside wall of said casing and a hot end directed toward a center of the self-positioning refractory structure.

2. A self-positioning refractory structure according to claim 1, wherein said straight interlocking means further comprise each of said positioning refractories and each of said filler refractories having a generally planar top, a generally planar bottom, a tread front and a tread back asymmetric about a first plane parallel to and equidistant from ridge faces of tread ridges of said tread front and said tread back; and a first tread side and a second tread side symmetric about a second plane parallel to and equidistant from groove faces of tread grooves of said first tread side and said second tread side.

3. A self-positioning refractory structure according to claim 2, wherein each said positioning refractory and each said filler refractory have one said tread ridge of said first tread side and said second tread side adjacent said generally planar bottom which is directed toward said center of the self-positioning refractory structure.

4. A self-positioning refractory structure according to claim 1, wherein said wedge interlocking means further comprise each said wedge refractory having a generally planar top, a generally planar bottom, a generally planar front and a generally planar back; and a first tread side and a second tread side symmetric about a plane passing through midpoints of said top and said bottom and perpendicular to said front and said back, and an overall shape of each said wedge refractory diverges along said first tread side and said second tread side from said top to said bottom.

5. A self-positioning refractory structure according to claim 4, wherein each said wedge refractory has a tread groove of said first tread side and said second tread side adjacent said generally planar bottom which is directed toward said center of the self-positioning refractory structure.

6. A self-positioning refractory structure according to claim 4, wherein a wedge thickness between said front and said back of each said wedge refractory is approximately equal to an overall thickness of each said positioning refractory and each said filler refractory and said overall thickness is defined as a distance between ridge faces of tread ridges of a tread front and a tread back of each said positioning refractory and said filler refractory.

7. A self-positioning refractory structure according to claim 1, wherein said wedge interlocking means further comprise each said wedge refractory having a generally planar top and a generally planar bottom;

a tread front and a tread back asymmetric about a first plane parallel to and equidistant from ridge faces of tread ridges of said tread front and said tread back; and a first tread side and a second tread side symmetric about a second plane passing through midpoints of said top and said bottom and perpendicular to said tread front and said tread back, and an overall shape of each said wedge refractory diverges along said first tread side and said second tread side from said top to said bottom.

8. A self-positioning refractory structure according to claim 7, wherein each said wedge refractory has a tread groove of said first tread side and said second tread side adjacent said generally planar bottom which is directed toward said center of the self-positioninged refractory structure.

9. A self-positioning refractory structure according to claim 7, wherein a wedge thickness between said front and said back of each said wedge refractory is approximately equal to an overall thickness of each said positioning refractory and each said filler refractory and said overall thickness is defined as a distance between ridge faces of tread ridges of a tread front and a tread back of each said positioning refractory and said filler refractory.

10. A self-positioning refractory structure according to claim 1, further comprising each said filler refractory interlocked between two said wedge refractories which are interlocked between two said positioning refractories.

11. A self-positioning refractory structure according to claim 1, further comprising a plurality of positioning refractory rings stacked and interlocked with respect to each other forming a self-positioning refractory ring wall within said cylindrical casing.

12. A self-positioning refractory structure according to claim 11, wherein each positioning refractory ring comprises a repeating sequence of a group of at least one said positioning refractory, at least one said filler refractory and at least one said wedge refractory.

13. A self-positioning refractory structure according to claim 12, wherein each said repeating sequence further comprises one said positioning refractory interlocked with a first said wedge refractory interlocked with one said filler refractory interlocked with a second said wedge refractory.

14. A self-positioning refractory structure according to claim 1, further comprising: at least one positioning refractory ring comprising each said filler refractory interlocked between two said wedge refractories which are interlocked between two said positioning refractories;

at least one non-positioning refractory ring each comprising alternating said filler refractories and said wedge refractories interlocked with respect to each other; and each said positioning refractory ring interlocked with respect to each said non-positioning refractory ring.

15. A self-positioning refractory structure according to claim 14, further comprising at least one group of said positioning refractory rings and non-positioning refractory rings wherein each said group comprises a plurality of said non-positioning refractory rings interlocked between two said positioning refractory rings and each said non-positioning refractory ring is interlocked with respect to each other.

16. A self-positioning refractory structure according to claim 15, wherein said plurality of said non-positioning refractory rings further comprise four said non-positioning refractory rings.

17. A self-positioning refractory structure according to claim 1, further comprising insulation between said inside wall of said casing and a filler cold end of each said filler refractory and a wedge cold end of each said wedge refractory.

18. A self-positioning refractory structure according to claim 17, wherein said insulation is in a layer form.

19. A self-positioning refractory structure according to claim 18, wherein said insulation is positioned adjacent said filler cold end of each said filler refractory and a wedge cold end of each said wedge refractory and a generally annular space is between said insulation and said inside wall of said casing.

20. A self-positioning refractory structure according to claim 19, wherein said insulation is about two inches thick.

21. A self-positioning refractory structure according to claim 18, wherein said insulation is positioned adjacent said inside wall of said casing and a generally annular space is between said insulation and said filler cold end of each said filler refractory and said wedge cold end of each said wedge refractory.

22. A self-positioning refractory structure according to claim 21, wherein said insulation is about two inches thick.

23. A self-positioning refractory structure according to claim 1 further comprising at least one shelf support secured to said inside wall of said casing and each said shelf support assists the self-positioning refractory structure with axial support.

24. In a furnace having a generally circular cross section, a self-positioning refractory structure comprising:

a generally cylindrical casing;

a plurality of positioning wedge refractories each having wedge interlocking means and a plurality of filler wedge refractories each having said wedge interlocking means, said positioning wedge refractories and said filler wedge refractories arranged to form a cross-sectionally curved structure within said cylindrical casing;

said positioning wedge refractories and said filler wedge refractories interlocked by said wedge interlocking means forming the self-positioning refractory structure; and a positioning length of each said positioning wedge refractory being greater than a filler length of each said filler wedge refractory, each said positioning wedge refractory having a cold end in positioning contact with an inside wall of said casing and a hot end directed toward a center of the self-positioning refractory structure.

25. A self-positioning refractory structure according to claim 24, wherein said wedge interlocking means further comprise each said positioning wedge refractory and each said filler wedge refractory having a generally planar top, a generally planar bottom, a generally planar front and a generally planar back; and a first tread side and a second tread side symmetric about a plane passing through midpoints of said top and said bottom and perpendicular to said front and said back, and an overall shape of each said positioning wedge refractory and each said filler wedge refractory diverges along said first tread side and said second tread side from said top to said bottom.

26. A self-positioning refractory structure according to claim 24, wherein said wedge interlocking means further comprise each said positioning wedge refractory and each said filler wedge refractory having a generally planar top and a generally planar bottom;

a tread front and a tread back asymmetric about a first plane parallel to and equidistant from ridge faces of tread ridges of said tread front and said tread back; and a first tread side and a second tread side symmetric about a second plane passing through midpoints of said top and said bottom and perpendicular to said tread front and said tread back, and an overall shape of each said wedge refractory diverges along said first tread side and said second tread side from said top to said bottom.

27. A self-positioning refractory structure according to claim 24, further comprising at least one filler wedge refractory interlocked between two said positioning wedge refractories.

28. A self-positioning refractory structure according to claim 24, further comprising a plurality of positioning refractory rings stacked and interlocked with respect to each other forming a self-positioning refractory ring wall within said cylindrical casing.

29. A self-positioning refractory structure according to claim 28, wherein each positioning refractory ring comprises a repeating sequence of a group of at least one said positioning wedge refractory and at least one said filler wedge refractory.

30. A self-positioning refractory structure according to claim 24, further comprising: at least one positioning refractory ring comprising a plurality of interlocked groups of refractories comprising at least one said filler wedge refractory interlocked between two said positioning wedge refractories;

at least one non-positioning refractory ring each comprising a plurality of said filler wedge refractories interlocked with respect to each other; and each said positioning refractory ring interlocked with respect to each said non-positioning refractory ring.

31. A self-positioning refractory structure according to claim 30, further comprising at least one ring group of said positioning refractory rings and non-positioning refractory rings wherein each said ring group comprises a plurality of said non-positioning refractory rings interlocked between two said positioning refractory rings and each said non-positioning refractory ring is interlocked with respect to each other.

32. A self-positioning refractory structure according to claim 24, further comprising insulation between said inside wall of said casing and a cold end of each said wedge refractory.

33. A self-positioning refractory structure according to claim 32, wherein said insulation is in a layer form.

* * * * *